US007826785B2

(12) United States Patent
Kinouchi et al.

(10) Patent No.: US 7,826,785 B2
(45) Date of Patent: Nov. 2, 2010

(54) FIXING DEVICE HAVING AN INDUCTION HEATING CONTROL MEMBER

(75) Inventors: Satoshi Kinouchi, Shinjuku-ku (JP); Osamu Takagi, Chofu (JP); Yoshinori Tsueda, Fuji (JP); Toshihiro Sone, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 883 days.

(21) Appl. No.: 11/695,266

(22) Filed: Apr. 2, 2007

(65) Prior Publication Data

US 2008/0240805 A1 Oct. 2, 2008

(51) Int. Cl.
*G03G 15/20* (2006.01)

(52) U.S. Cl. ..... 399/328; 399/334

(58) Field of Classification Search ..... 399/69, 399/328, 329, 330, 334; 219/619
See application file for complete search history.

(56) References Cited

U.S. PATENT DOCUMENTS 7,016,622 B2 * 3/2006 Kinouchi et al. ..... 219/619
7,020,426 B2 * 3/2006 Takagi et al. ..... 399/330
7,045,749 B2 * 5/2006 Kinouchi et al. ..... 219/619
7,184,697 B2 * 2/2007 Kinouchi et al. ..... 399/328
7,215,919 B2 * 5/2007 Kinouchi et al. ..... 399/334
7,580,649 B2 * 8/2009 Takagi et al. ..... 399/69

FOREIGN PATENT DOCUMENTS

JP 09-106207 4/1997
JP 2001-185338 7/2001
JP 2005-093352 4/2005

* cited by examiner

*Primary Examiner*—William J Royer
(74) *Attorney, Agent, or Firm*—Turocy & Watson, LLP

(57) ABSTRACT

In an induction heating fixing device according to the invention, a first induction heating coil that generates an induced current across the total length of a heat roller is provided on the outer circumference of the heat roller having a metal conductive layer. A second induction heating coil that generates an induced current at a central part of the heat roller is provided, which crosses the first induction heating coil and is arranged on the outer side than the first induction heating coil. With the first induction heating coil, the heat roller is heated across the total length without generating any uneven temperature. On-off control of the first induction heating coil and the second induction heating coil is carried out, and the temperature distribution in the longitudinal direction of the heat roller is kept constant irrespective of the size of a sheet of paper P.

24 Claims, 10 Drawing Sheets

FIG. 16
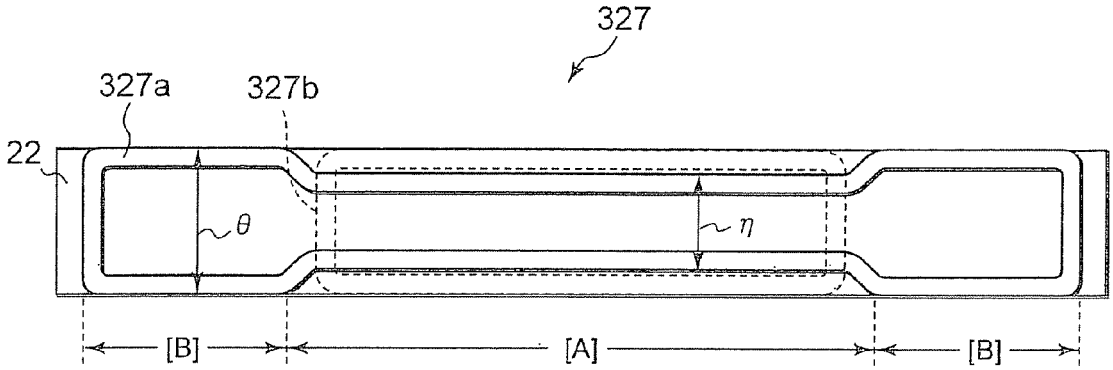
FIG. 17
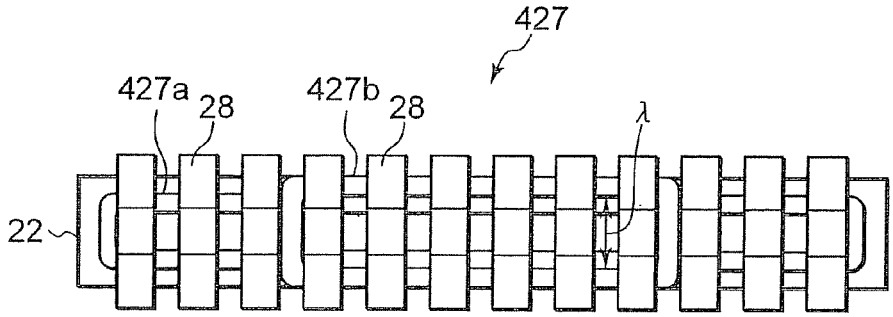
FIG. 18
| | L(μH) | R(Ω) | L/R(μH/Ω) |
|---|---|---|---|
| COIL THAT HEATS ENTIRE ROLLER | 29 | 1.2 | 24.2 |
| COIL THAT HEATS CENTRAL PART OF ROLLER | 27 | 1 | 27 |

FIXING DEVICE HAVING AN INDUCTION HEATING CONTROL MEMBER

BACKGROUND OF THE INVENTION

1. Field of the Invention

The present invention relates to an induction heating fixing device that is loaded in an image forming apparatus such as a copy machine, printer or facsimile and that fixes a toner image to a paper by using a heating member heated by induction heating.

2. Description of the Background

As a fixing device used in an image forming apparatus such as an electrophotographic copy machine or printer, there is a device that inserts a sheet of paper between a pair of rollers including a heat roller and a pressurizing roller or into a nipping part formed between similar belts, and then fixes a toner image by heating and pressurizing. As such a heating-type fixing device, there is an induction heating fixing device that heats a metal conductive layer on the surface of a heat roller or a heating belt by an induction heating method in order to realize a higher process speed. In the induction heating method, predetermined power is supplied to an induction heating coil to generate a magnetic field there, and the metal conductive layer is instantaneously heated by an eddy-current generated in the metal conductive layer by the magnetic field. Thus, the heat roller or heating belt is heated.

As a fixing device based on the induction heating method as described above, there traditionally is a device in which the induction heating coil is divided into plural parts to realize even temperature distribution in the longitudinal direction of the heat roller. For example, JP-A-09-106207 or JP-A-2001-185338 discloses an induction heating fixing device in which plural induction heating coils, divided as plural parts in the longitudinal direction of the heat roller, are selectively driven to realize even temperature of the heat roller across the total length in the longitudinal direction.

However, in all of these traditional induction heating fixing devices, there is a gap at a joint part between the neighboring induction heating coils. Therefore, the magnetic field changes at the joint part and may cause uneven temperature in the heat roller. Moreover, in the traditional induction heating device, since the divided plural induction heating coils are selectively driven, for example, when the heat roller as a whole is to be supplied with 1000 W, each area of the divided induction heating coils requires 1000 W. For example, to selectively drive two induction heating coils and heat the heat roller across its total length, each of the two induction heating coils must be supplied with 1000 W. Therefore, the electrical quantity per unit area of the heat roller is large. This can be a factor that increases temperature variance in the heat roller corresponding to each induction heating coil.

In the case where the plural induction heating coils are simultaneously driven in order to reduce temperature variance in the heat roller, since the plural induction heating coils have driving frequencies from each other, interference noise occurs at the time of driving and it additionally causes the risk of increased noise. Moreover, the traditional induction heating fixing device is not configured in consideration of improvement in the uneven temperature between a paper passing part and a non-paper passing part due to the size of a sheet of paper. Therefore, there is a risk that the temperature of the non-paper passing part may be raised by continuous paper passing and adversely affect peripheral devices.

Thus, in the fixing device in which the metal conductive layer is heated by the induction heating coil, the occurrence of uneven temperature in the longitudinal direction of the heat roller is to be prevented. Particularly, development of an induction heating fixing device is desired in which the temperature rise in the non-paper passing part due to the size of a sheet of paper is prevented to realize a stable fixing property.

SUMMARY OF THE INVENTION

An aspect of the invention provides an induction heating fixing device in which a heat roller is evenly heated across its total length in the longitudinal direction by an induction heating coil without causing uneven temperature, and a non-paper passing part is heated at the time of fixation on a small-size sheet of paper, and in which temperature rise is thus prevented and an even and stable fixing property is provided.

According to an embodiment of the invention, an induction heating fixing device includes an endless heating member having a metal conductive layer, a first induced current generating coil arranged on an outer circumference of the heating member and configured to generate an induced current in the metal conductive layer across a total length in the direction of a rotation axis of the heating member, a second induced current generating coil arranged on the outer circumference of the heating member and configured to generate an induced current in the metal conductive layer at a part in the direction of the rotation axis of the heating member, and a control member capable of driving the first induced current generating coil or the second induced current generating coil in a switching manner.

BRIEF DESCRIPTION OF THE DRAWINGS

FIG. 16 is a schematic top view showing a state where a magnetic core of an induction heating coil has been eliminated, according to a fourth embodiment of the invention;

FIG. 17 is a schematic plan view showing an induction heating coil according to a fifth embodiment of the invention;

FIG. 18 is a table showing the properties of a first induction heating coil and a second induction heating coil according to the fifth embodiment of the invention;

DETAILED DESCRIPTION OF THE INVENTION

Figure 1:
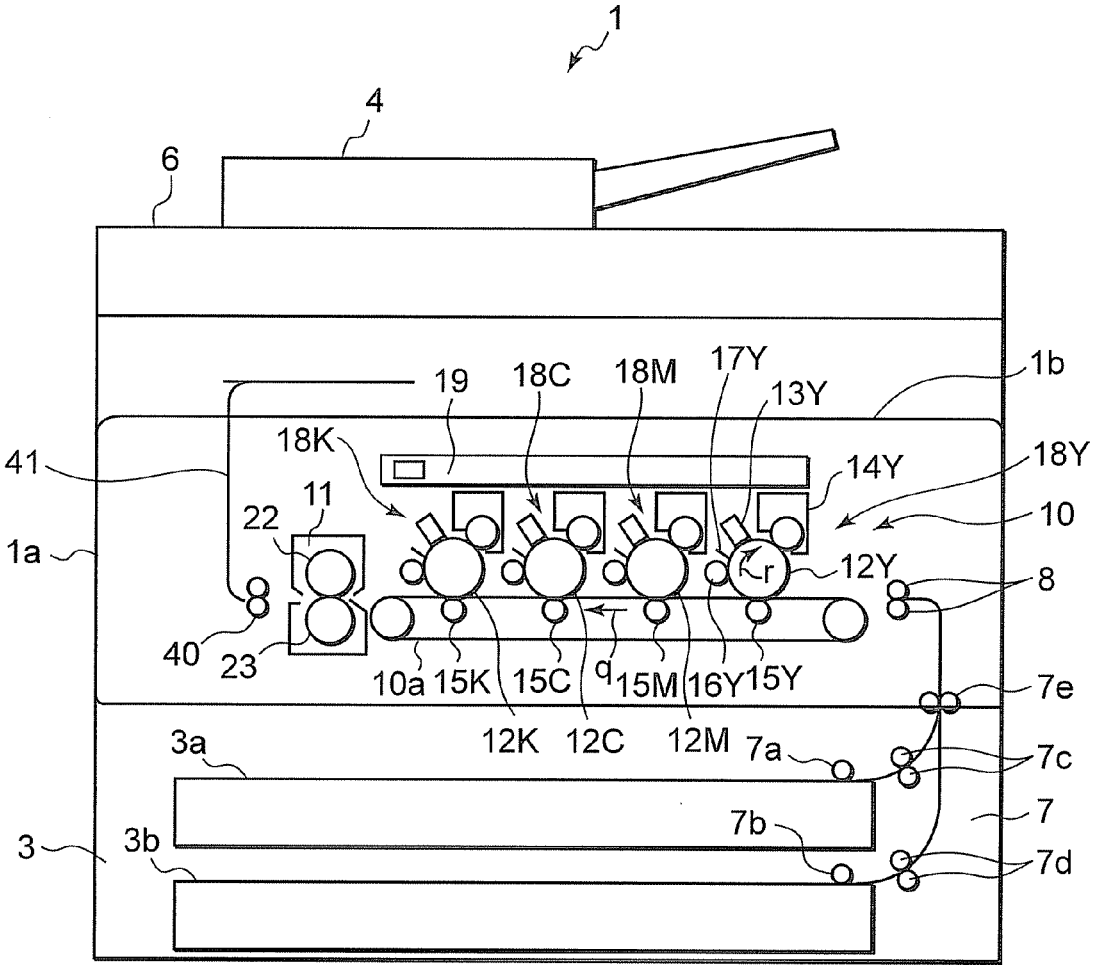
FIG. 1 is a schematic configuration view showing an image forming apparatus according to a first embodiment of the invention.

Hereinafter, a first embodiment of the invention will be described in detail with reference to the accompanying drawings as examples. FIG. 1 is a schematic configuration view showing an image forming apparatus 1 according to the embodiment of the invention. A scanner unit 6 that reads an original supplied by an automatic document feeder 4 is provided on the top of the image forming apparatus 1. The image forming apparatus 1 has a cassette mechanism 3 that supplies a sheet of paper P, which is a fixing target medium, to an image forming unit 10.

The cassette mechanism 3 has first and second paper feed cassettes 3*a* and 3*b*. In a carrier path 7 from the respective paper feed cassettes 3*a*, 3*b* to the image forming unit 10, there are provided pickup rollers 7*a*, 7*b* that take out sheet of papers from the paper feed cassettes 3*a*, 3*b*, separating and carrying rollers 7*c*, 7*d*, carrying rollers 7*e*, and resist rollers 8. A fixing device 11 that fixes a toner image formed on the sheet of paper P by the image forming unit 10 is provided downstream of the image forming unit 10. Downstream of the fixing device 11, paper discharge rollers 40 are provided and a paper discharge carrier path 41 is provided that carries the sheet of paper P after the fixation to a paper discharge unit 1*b*.

The image forming unit 10 has image forming stations 18Y, 18M, 18C and 18K for respective colors of yellow (Y), magenta (M), cyan (C) and black (K). The image forming stations 18Y, 18M, 18C and 18K are arrayed in tandem along a transfer belt 10*a* turned in the direction of an arrow q.

In the yellow (Y) image forming station 18Y, a charger 13Y, a developing device 14Y, a transfer roller 15Y, a cleaner 16Y, and an electricity eliminator 17Y, which are process members, are arranged around a photoconductive drum 12Y, which is an image carrier rotating in the direction of an arrow r. Also, a laser exposure device 19 that casts a laser beam to the photoconductive drum 12Y is provided above the yellow (Y) image forming station 18Y.

The image forming stations 18M, 18C and 18K of the respective colors of magenta (M), cyan (C) and black (K) have a configuration similar to that of the yellow (Y) image forming station 18Y.

In the yellow (Y) image forming station 18Y, the photoconductive drum 12Y, and the charger 13Y, the developing device 14Y, the cleaner 16Y and the electricity eliminator 17Y around the photoconductive drum 12Y form a process cartridge, and it is integrally attachable to and removable from a body 1*a*. The configuration of the process cartridge is not limited, and may be any configuration as long as at least one of the charger, the developing unit and the cleaner, and the photoconductive drum are integrally supported and it is attachable to and removable from the body 1*a* of the image forming apparatus 1. An arbitrary configuration may be employed, for example, a process cartridge in which only a developing unit and a cleaner around a photoconductive drum are integrated and made integrally attachable to and removable from the body 1*a* of the image forming apparatus 1.

In the image forming unit 10, as a print operation starts, in the yellow (Y) image forming station 18Y, the photoconductive drum 12Y rotates in the direction of the arrow r and is uniformly charged by the charger 13Y. Next, by the laser exposure device 19, the photoconductive drum 12Y is irradiated with exposure light corresponding to image information read by the scanner unit 6, and an electrostatic latent image is formed thereon. After that, a toner image is formed on the photoconductive drum 12Y by the developing device 14Y, and at the position of the transfer roller 15Y, the toner image is transferred to the sheet of paper P carried on the transfer belt 10*a* in the direction of the arrow q. After the end of the transfer, the remaining toner on the photoconductive drum 12Y is cleaned by the cleaner 16Y, and the electricity on the surface of the photoconductive drum 12Y is eliminated by the electricity eliminator 17Y to enable next printing.

The image forming stations 18M, 18C and 18K for the respective colors of magenta (M), cyan (C) and black (K) perform an image forming operation similar to that of the yellow (Y) image forming station 18Y, and form a full-color toner image on the sheet of paper P. After that, fixation by heating and pressurizing is performed on the sheet of paper P by the fixing device 11, which is an induction heating fixing device. A print image is completed and the sheet of paper P is discharged to the paper discharge unit 1*b*.

Figure 2:
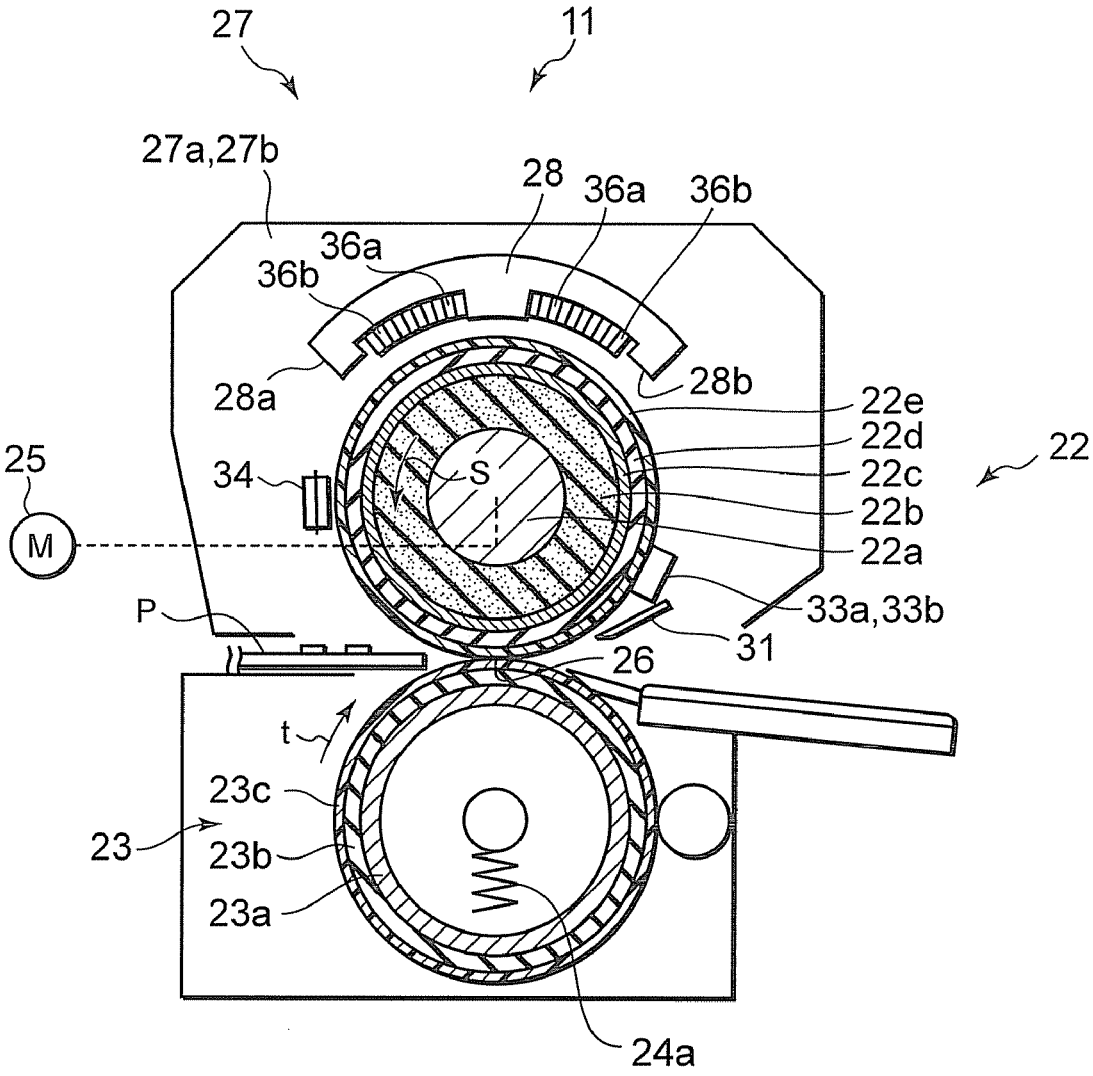
FIG. 2 is a schematic configuration view showing a fixing device according to the first embodiment of the invention.

Next, the fixing device 11 will be described. FIG. 2 is a schematic configuration view showing the fixing device 11. The fixing device 11 has a heat roller 22, which is a heating member, and a press roller 23, which is a pressurizing member. The heat roller 22 is driven in the direction of an arrow s by a driving motor 25. The press roller 23 is pressed in contact with the heat roller 22 by a pressurizing mechanism having a compression spring 24*a*. Thus, a nipping part 26 with a predetermined width is formed between the heat roller 22 and the press roller 23. The press roller 23 follows the heat roller 22 and rotates in the direction of an arrow t.

Moreover, the fixing device 11 has an induction heating coil 27 that heats the heat roller 22, with a gap of approximately 3 mm on the outer circumference of the heat roller 22. The induction heating coil 27 is substantially coaxial with the heat roller 22. Also, on the outer circumference of the heat roller 22, there is provided a stripping pawl 31 that prevents the paper P after fixation from winding thereon, a first thermistor 33*a* and a second thermistor 33*b* that detect the surface temperature of the heat roller 22, and a thermostat 34 that detects abnormality in the surface temperature of the heat roller 22 and interrupts the heating. The stripping pawl 31 may be of either contact-type or non-contact type.

The heat roller 22 includes, around a metal core 22*a*, a foam rubber (sponge) 22*b* with a thickness of 5 mm, a metal conductive layer 22*c* made of nickel (Ni) with a thickness of 40 μm, a solid rubber layer 22*d* with a thickness of 200 μm, and a separation layer 22*e* with a thickness of 30 μm. The metal conductive layer 22*c* is not limited to nickel and may also be made of stainless steel, aluminum, a composite material of stainless steel and aluminum, and the like.

The press roller 23 includes a metal core 23*a* with a thickness of 2 mm, a solid silicon rubber layer 23*b* with a thickness of 1 mm, and a separation layer 23*c* with a thickness of 30 μl. Both of the heat roller 22 and the press roller 23 have a diameter of 40 mm. As the sheet of paper P passes through the nipping part 26 between the heat roller 22 and press roller 23, a toner image on the sheet of paper P is fixed by heating and pressurizing.

The induction heating coil 27 includes a first induction heating coil 27*a*, which is a first induced current generating coil, and a second induction heating coil 27*b*, which is a second induced current generating coil. The first induction heating coil 27*a* has a length of 320 mm and heats the entire length of the heat roller 22. The second induction heating coil 27*b* has a length of 200 mm and heats the central area of the heat roller 22. The first induction heating coil 27*a* has a first coil 36*a* formed by six turns of an electric wire on a magnetic core 28, which is a first core and a second core. The second induction heating coil 27*a* has a second coil 36*b* formed by eight turns of an electric wire on the magnetic core 28.

The number of turns of the electric wire of the first induction heating coil 27*a* can be made smaller than that of the second induction heating coil 27*b*. This is because the induction heating coil 27 is substantially coaxial with the heat roller 22 and the first induction heating coil 27*a* and the second induction heating coil 27*b* are arranged substantially at the same distance of 3 mm to the heat roller 22.

That is, the first induction heating coil 27*a*, which faces the heat roller 22 across the total length in the longitudinal direction of the heat roller 22, has a broader magnetic coupling area with the heat roller 22 than the second induction heating coil 27*b* does, which faces the central part of the heat roller 22, and therefore the first induction heating coil 27*a* has stronger magnetic coupling. Since the first induction heating coil 27*a* has stronger magnetic coupling with the heat roller 22, it has greater load resistance. Therefore, its power can be increased in proportion to the load resistance and the number of turns of the electric wire can be reduced.

Here, the load resistance refers to the addition of a resistance generated as the heat roller 22 and the first induction heating coil 27*a* are brought closer to each other, and a resistance value equivalent mainly to a copper loss proper to the induction heating coil. When the heat roller 22 and the first induction heating coil 27*a* are brought closer to each other, mutual induction causes magnetic coupling and it gradually becomes stronger. As this magnetic coupling becomes stronger, the resistance increases and hence the load resistance including this resistance increases. Therefore, in the first induction heating coil 27*a*, stronger magnetic coupling means greater load resistance. Thus, in the first induction heating coil 27*a*, since its magnetic coupling with the heat roller 22 is strong, it is possible to reduce the number of turns of the electric wire when predetermined power is sought.

On the other hand, the second induction heating coil 27*b*, which faces the central part of the heat roller 22, tends to have weaker magnetic coupling with the heat roller 22 than the first induction heating coil 27*a* does. Therefore, the number of turns of the electric wire is increased.

The distance between the first induction heating coil 27*a* and the second induction heating coil 27*b*, and the heat roller 22, is not limited to 3 mm. The heat roller 22 can be efficiently heated as long as the distance is within the range of approximately 1 to 5 mm.

The electric wire is made of a Litz wire, which is a bundle of plural copper wires insulated from each other. Since a Litz wire is used as the electric wire and the wire diameter is reduced in accordance with the depth of penetration, an alternating current can be caused to flow effectively. In this embodiment, the electric wire is a Litz wire formed by a bundle of 16 copper wires with a wire diameter of 0.5 mm. Heat-resistant polyamideimide is used as the insulating material for the electric wire.

The magnetic core 28 is dispersed in plural parts in the longitudinal direction of the heat roller 22, and has a shape to cover the first and second coils 36*a* and 36*b*. Magnetic shielding members 28*a* and 28*b* are arranged to protrude on both sides of the magnetic core 28. With such a shape, the magnetic core 28 can locally and intensively heat the heat roller 22 by concentrating magnetic fluxes onto the heat roller 22.

Figure 3:
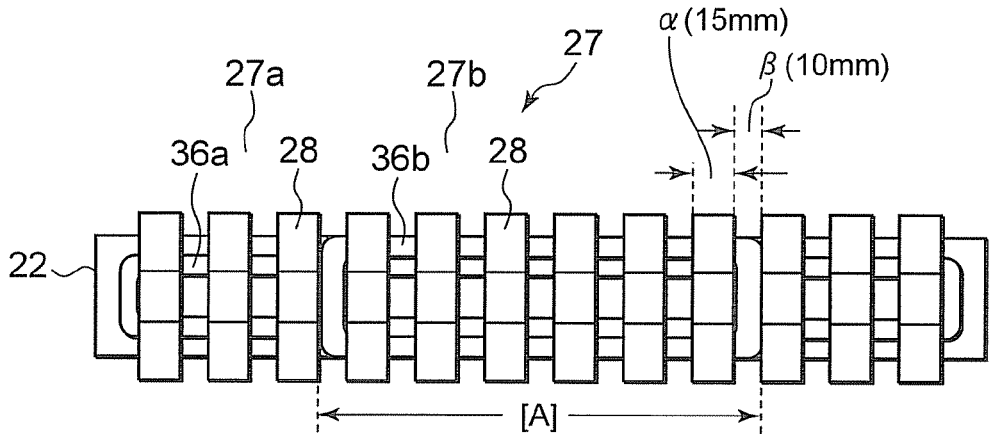
FIG. 3 is a schematic plan view showing an induction heating coil according to the first embodiment of the invention.
Figure 4:
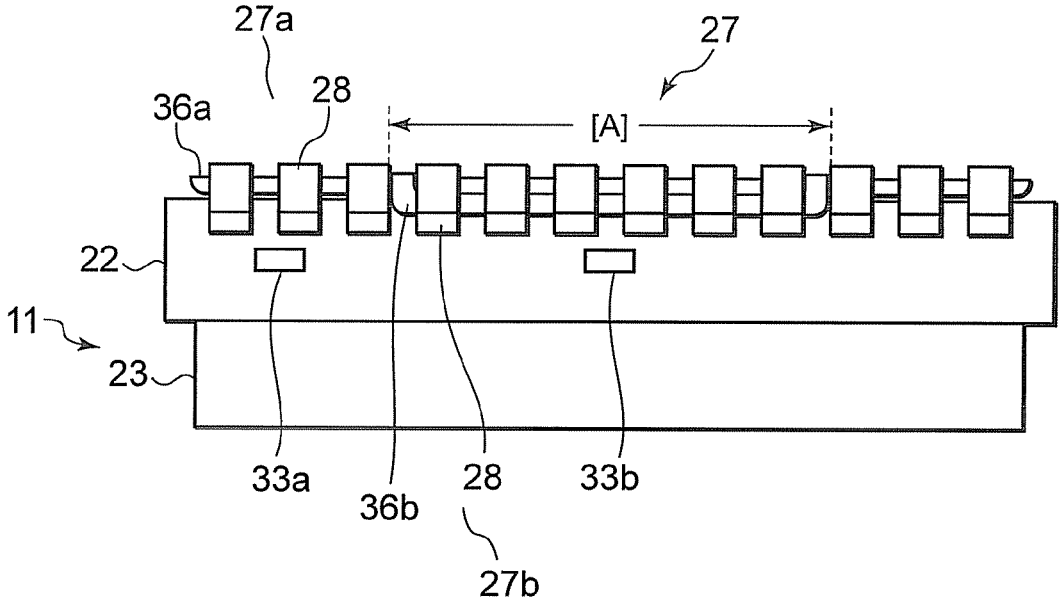
FIG. 4 is a schematic side view showing the induction heating coil according to the first embodiment of the invention.

As shown in FIG. 3 or FIG. 4, each of the plural magnetic cores 28 has a width a of 15 mm. A gap P between the neighboring magnetic cores 28 is 10 mm in order not to cause uneven temperature in the heat roller 22. If the gap between the neighboring magnetic cores 28 is too wide, uneven temperature may occur. The first induction heating coil 27*a* and the second induction heating coil 27*b* share the same magnetic core 28 in an area [A].

Figure 5:
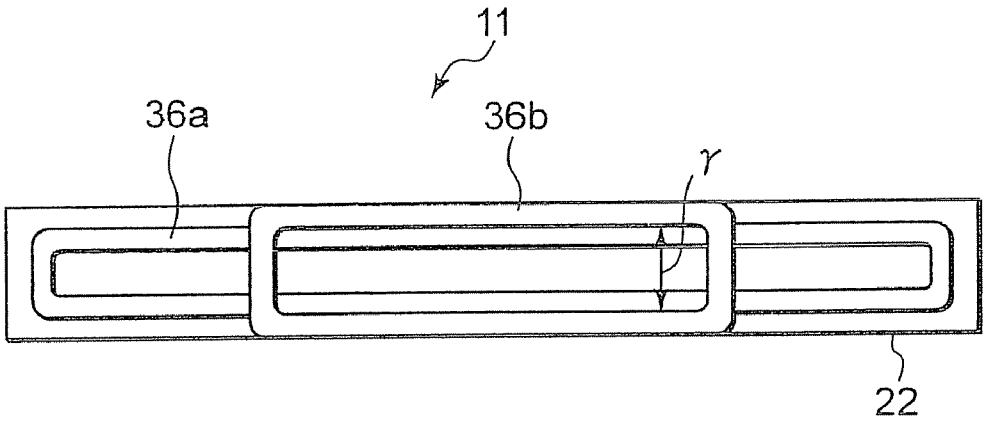
FIG. 5 is a schematic plan view showing a state where a magnetic core of the induction heating coil has been eliminated, according to the first embodiment of the invention.
Figure 6:
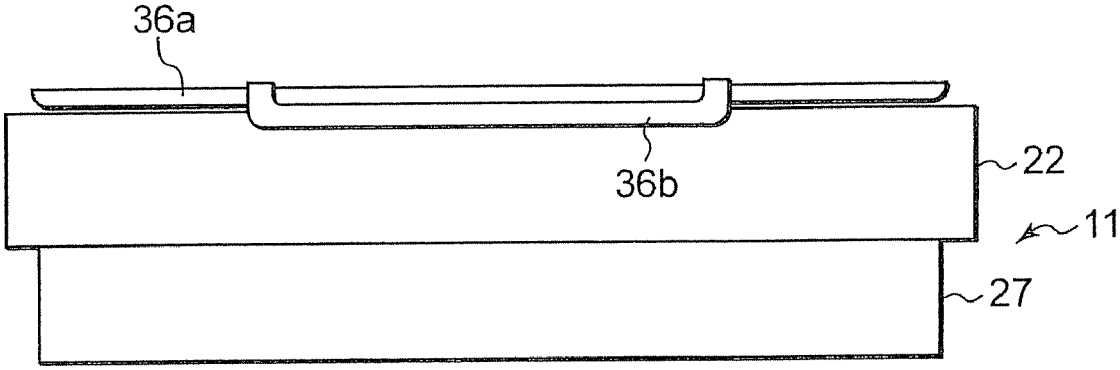
FIG. 6 is a schematic side view showing the state where the magnetic core of the induction heating coil has been eliminated, according to the first embodiment of the invention.

Also, in the area [A], if the first coil 36*a* and the second coil 36*b* overlap each other with respect to the heat roller 22, the magnetic flux in the overlapped part is interrupted and the heating efficiency is significantly lowered. Therefore, the first coil 36*a* and the second coil 36*b* are arranged without overlapping each other in the direction of the heat roller 22. That is, as shown in FIG. 5 or FIG. 6, the second coil 36*b* is formed to cross the first coil 36*a* and is arranged on the outer side than the first coil 36*a* in the direction parallel to the longitudinal direction of the heat roller 22. As the second coil 36*b* is thus arranged on the outer side than the first coil 36*a*, the inner gap of the second coil 36*b* indicated by γ in FIG. 5 can be made broad. This enables further increase of the magnetic coupling area of the second induction heating coil 27*b* and the heat roller 22.

As a high-frequency current is applied, the first induction heating coil 27*a* and the second induction heating coil 27*b* generate magnetic fluxes. These magnetic fluxes cause an eddy-current to be generated in the heat roller 22 in order to prevent changes in the magnetic field. This eddy-current and the resistance of the heat roller 22 generate Joule heat and the heat roller 22 is heated. The first thermistor 33*a* detects the temperature of the heat roller 22 heated by the first induction heating coil 27*a*. The second thermistor 33*b* detects the temperature of the central part (area [A]) of the heat roller 22 heated by the first induction heating coil 27*a* or the second induction heating coil 27*b*.

Figure 7:
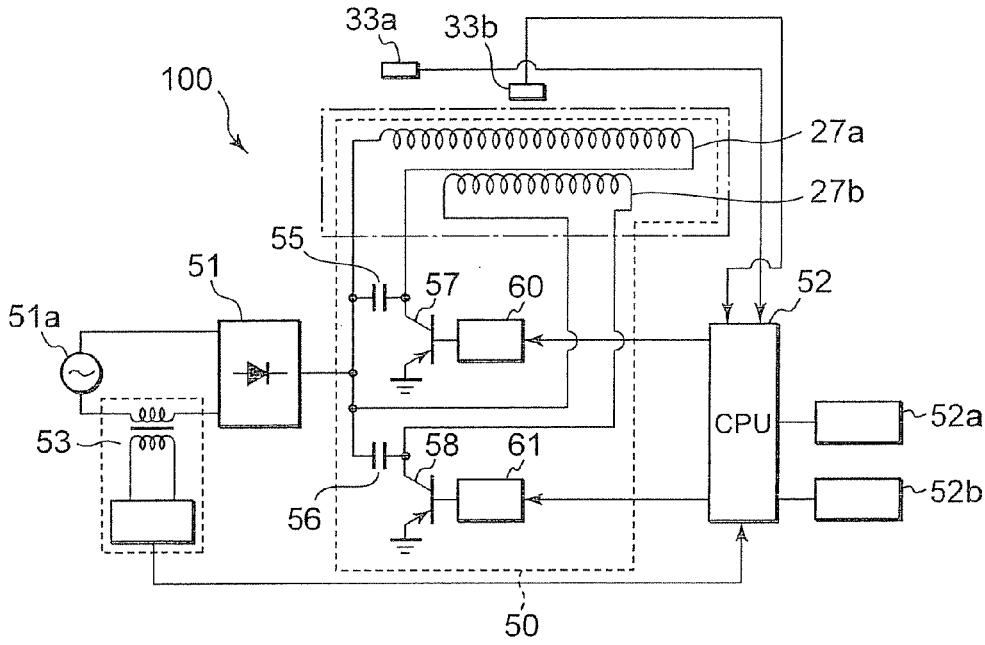
FIG. 7 is a schematic block diagram showing a control system according to the first embodiment of the invention.

Next, a control system 100 will be described, which is a control member for the induction heating coil 27 heating the heat roller 22. As shown in FIG. 7, the control system 100 has an inverter circuit 50 that supplies a driving current to the first induction heating coil 27*a* and the second induction heating coil 27*b*, a rectifying circuit 51 that supplies 100-V DC power to the inverter circuit 50, and a CPU 52 that controls the entire image forming apparatus 1 and also controls the inverter circuit 50 in accordance with the result of detection by the thermistors 33*a*, 33*b*. The CPU 52 has a main memory 52*a* or a storage device 52*b* and the like. In accordance with the result of detection by the thermistors 33*a*, 33*b*, the CPU 52 drives either the first induction heating coil 27*a* or the second induction heating coil 27*b* to make an output, or turns both of them off.

The rectifying circuit 51 rectifies a current from a commercial AC power source 51*a* to a 100-V DC and supplies it to the inverter circuit 50. A transformer 53 is arranged in the stage preceding the rectifying circuit 51. This enables detection of the total power consumption. The power provided from the commercial AC power source 51*a* is detected and a feedback is made to the CPU 52.

As the inverter circuit 50, a self-excited quasi-E class circuit is used. Resonance capacitors 55 and 56 are connected parallel to the first induction heating coil 27*a* and the second induction heating coil 27*b* of the inverter circuit 50. Switching devices 57 and 58 are connected to these capacitors 55 and 56. As the switching devices 57 and 58, IGBTs, MOS-FETs and the like are used which can be used with a high withstand voltage and a large current.

Driving circuits 60 and 61 are connected respectively to the control terminals of the switching device 57 and 58. The driving circuits 60 and 61 apply a driving voltage to the control terminals of the switching devices 57 and 58 to turn on the switching devices 57 and 58. The CPU 52 controls the timing of application of the driving voltage from the driving circuits 60 and 61. The inverter circuit 50 controls the ON-time of the switching devices 57 and 58 by the CPU 52, makes the frequency variable within a range of 20 to 100 kHz, and causes a current to flow through the first induction heating coil 27*a* or the second induction heating coil 27*b*. By making the driving frequency variable, the inverter circuit 50 can supply power of 600 W or more and up to 1500 W to the first induction heating coil 27*a* or the second induction heating coil 27*b*.

The inverter circuit 50 may have a circuit specification using a half-bridge type circuit that adjusts an output by pulse width (PWM) control, instead of adjusting the variable output based on the frequency.

Figure 8:
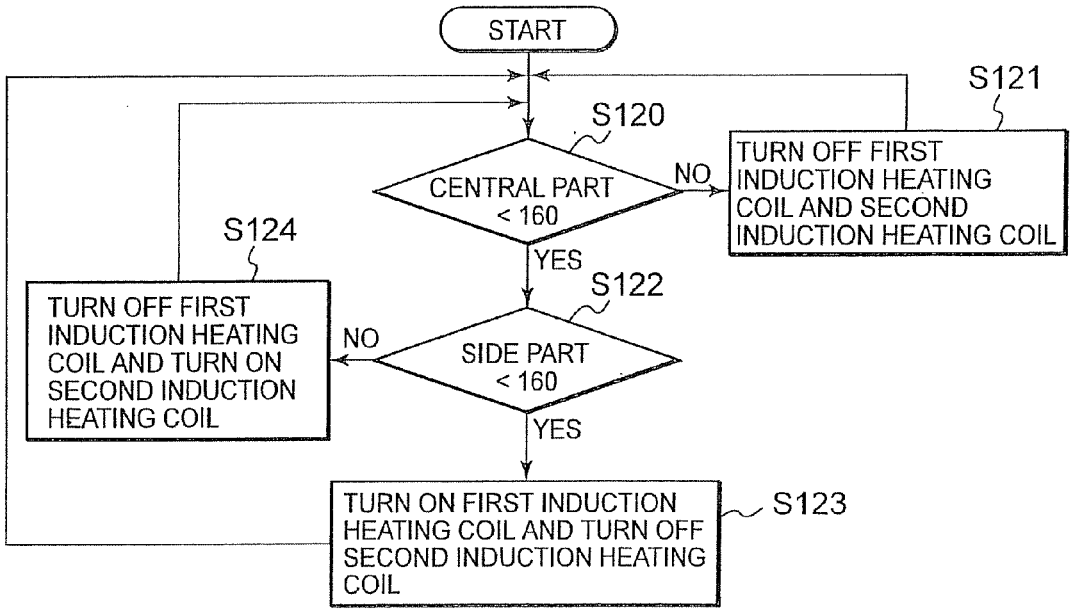
FIG. 8 is a flowchart showing temperature control of the induction heating coil according to the first embodiment of the invention.

Next, the temperature control of the induction heating coil 27 by the control system 100 will be described with reference to the flowchart of FIG. 8. The first induction heating coil 27*a*, supplied with power from the inverter circuit 50, heats the heat roller 22 across its total length. The second induction heating coil 27*b*, supplied with power from the inverter circuit 50, heats the central part of the heat roller 22. After the start, whichever of the first induction heating coil 27*a* and the second induction heating coil 27*b* is supplied with power, if the second thermistor 33*b* detects that the temperature of the central part of the heat roller 22 is 160° C. or higher (No in step S120), both of the first induction heating coil 27*a* and the second induction heating coil 27*b* are turned off (step S121).

If the second thermistor 33*b* detects that the temperature of the central part of the heat roller 22 is less than 160° C. (Yes in step S120), the first thermistor 33*a* detects whether the temperature of the side part of the heat roller 22 is less than 160° C. or not (step S122). If the temperature of the side part of the heat roller 22 is less than 160° C., the first induction heating coil 27*a* is turned on and the second induction heating coil 27*b* is turned off (step S123). Thus, the heat roller 22 is heated across its total length. On the other hand, if the temperature of the side part of the heat roller 22 is 160° C. or higher, the first induction heating coil 27*a* is turned off and the second induction heating coil 27*b* is turned on (step S124). Thus, the area [A] in the central part of the heat roller 22 is heated.

Next, the operation will be described. As an image forming process starts, in the image forming unit 10, the image forming stations 18Y, 18M, 18C and 18K for the colors of yellow (Y), magenta (M), cyan (C) and black (K) form toner images on the respective photoconductive drums 12Y, 12M, 12C and 12K. The toner images on the photoconductive drums 12Y, 12M, 12C and 12K are transferred by the transfer rollers 15Y, 15M, 15C and 15K to the sheet of paper P on the transfer belt 10*a* turned in the direction of the arrow q, and a full-color toner image is thus formed on the sheet of paper P. After that, fixation by heating and pressurizing is performed on the sheet of paper P by the fixing device 11, and the print image is completed.

As the image forming process starts, in the fixing device 11, the heat roller 22 is driven in the direction of the arrow s by the driving motor 25, and the press roller 23 following this is rotated in the direction of the arrow t. Moreover, in the fixing device 11, the CPU 52 controls the inverter circuit 50 in accordance with the result of detecting the surface temperature of the heat roller 22 by the thermistors 33*a* and 33*b*. The inverter circuit 50 selectively switches the first induction heating coil 27*a* or the second induction heating coil 27*b* and raises the temperature of the heat roller 22, thus maintaining the fixing temperature.

At the start of the image forming process, the first induction heating coil 27*a* is supplied with a current of 40 kHz. Thus, the heat roller 22 reaches a desired fixation-enabling temperature of 160° C. at a high speed of about 30 seconds. In this case, since the first induction heating coil 27*a* is integral and the coil is seamless, the heat roller 22 maintains an even fixing temperature across its total length. After that, in the fixing device 11, the turning on and off of the first induction heating coil 27*a* and the second induction heating coil 27*b* is controlled by the inverter circuit 50 in accordance with the flowchart of FIG. 8. Thus, the temperature distribution in the longitudinal direction of the heat roller 22 is kept constant while the fixing operation is carried out.

If the size of the sheet of paper P on which the toner image is formed is a full size, for example, A4 horizontal size (297×210 mm) or A3 size (297×420 mm) of the JIS standard, the fixing device 11 performs fixation by heating and pressurizing, using the total length in the longitudinal direction of the heat roller 22. Therefore, while the fixing operation is carried out, the temperature of the heat roller 22 is lowered substantially evenly across the total length in the longitudinal direction. That is, the first thermistor 33*a* detects that the temperature of the side part of the heat roller 22 is less than 160° C. (Yes in step S122). Therefore, the inverter circuit 50 turns on the first induction heating coil 27*a* to heat the heat roller 22 across its total length.

Meanwhile, if the size of the sheet of paper P is a small size, for example, A4 vertical size (210×297 mm) or B5 size (182×257 mm) of the JIS standard, the fixing device 11 performs fixation by heating and pressurizing, using a part of the central part of the heat roller 22. Therefore, while the fixing operation is carried out, the temperature is lowered in the central part area of the heat roller 22 where the sheet of paper P passes, but the temperature rises in both side areas where the sheet of paper P does not pass. That is, the second thermistor 33*b* detects that the temperature of the central part of the heat roller 22 is less than 160° C. (Yes in step S120), and the first thermistor 33*a* detects that the temperature of the side part of the heat roller 22 is 160° C. or higher (No in step S122). Therefore, the inverter circuit 50 turns off the first induction heating coil 27*a* and the turns on the second induction heating coil 27*b* to heat the area [A] in the central part of the heat roller 22.

In this manner, the current supply to the first induction heating coil 27*a* and the second induction heating coil 27*b* is controlled, and the temperature distribution in the longitudinal direction of the heat roller 22 is kept constant irrespective of the size of the sheet paper P. When the image forming process has ended, the driving motor 25 is stopped and the current supply to the first induction heating coil 27*a* and the second induction heating coil 27*b* is stopped.

According to this embodiment, in the fixing operation by the fixing device 11, the first induction heating coil 27*a* capable of heating the heat roller 22 across its total length in the longitudinal direction and the second induction heating coil 27*b* capable of heating the central area of the heat roller 22 are driven or stopped in a switching manner. Therefore, the heat roller 22 is heated across its total length by the first induction heating coil 27*a* alone which has no coil joint, uneven temperature in the heat roller 22 that would traditionally be caused by the joint of the coil can be prevented. As a result, a stable fixing property is provided across the total length in the longitudinal direction of the heat roller 22.

Also, according to this embodiment, when the heat roller 22 is heated, the single first induction heating coil 27*a* is supplied with the electrical quantity required by the entire heat roller 22. Therefore, the electrical quantity per unit area of the heat roller 22 can be reduced, compared with the traditional device in which plural induction heating coils are selectively driven to heat the heat roller across the total length in the longitudinal direction. For example, the electrical quantity per unit area of the heat roller 22 can be reduced to half, compared with the traditional device in which two induction heating coils are selectively driven to heat the heat roller across the total length. Thus, temperature variance in the heat roller 22 can be reduced, compared with the traditional device. Moreover, since the heat roller 22 is heated across its total length by the single first induction heating coil 27*a*, there is no occurrence of interference noise, which would be caused by simultaneous driving of plural induction heating coils as in the traditional device.

Also, since the first and second thermistors 33*a* and 33*b* detect the temperature of the heat roller 22 and the inverter circuit 50 controls turning on and off of the first induction heating coil 27*a* and the second induction heating coil 27*b*, the temperature distribution in the longitudinal direction of the heat roller 22 can be kept constant irrespective of the size of the sheet of paper P. Therefore, there is no adverse effect of a temperature rise at the end of the heat roller 22 on the peripheral devices, and a good fixing property can be constantly provided across the total length in the longitudinal direction.

Next, a second embodiment of the invention will be described. This second embodiment differs from the above first embodiment in the way of winding the second coil of the second induction heating coil, and the other parts are similar to those of the first embodiment. Therefore, in this second embodiment, the same configuration as the configuration described in the above first embodiment is denoted by the same reference numerals and will not be described further in detail.

Figure 9:
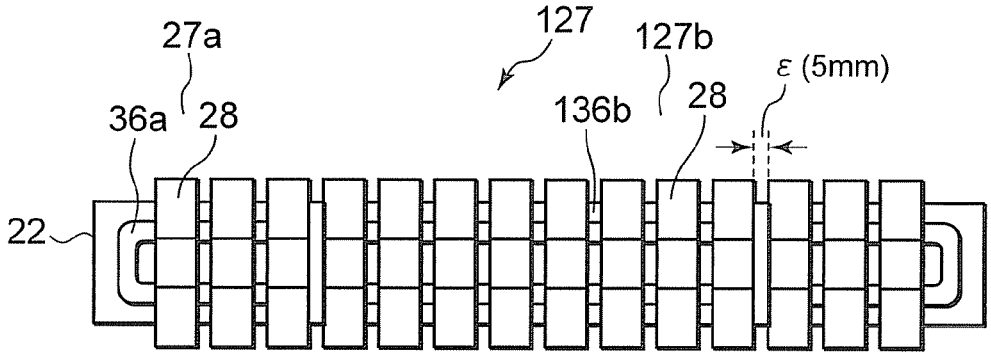
FIG. 9 is a schematic plan view showing an induction heating coil according to a second embodiment of the invention.
Figure 10:
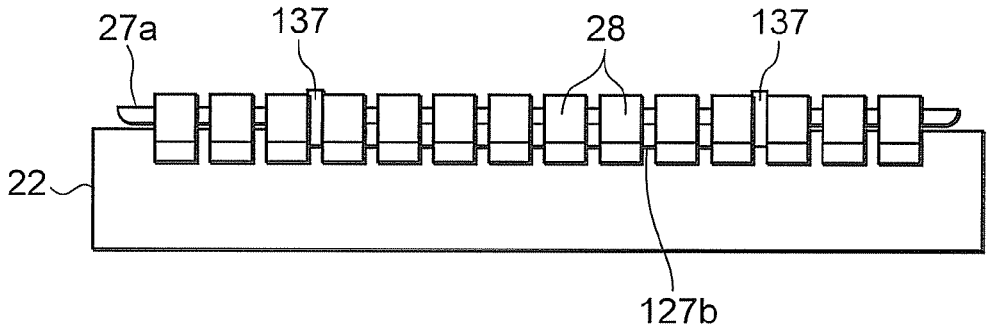
FIG. 10 is a schematic side view showing the induction heating coil according to the second embodiment of the invention.

The second embodiment has an induction heating coil 127 shown in FIG. 9 and FIG. 10, in order to heat the heat roller 22. The induction heating coil 127 is substantially coaxial with the heat roller 22. The induction heating coil 127 includes a first induction heating coil 27*a* and a third induction heating coil 127*b*, which is a second induced current generating coil with a length of 200 mm to heat the central area of the heat roller 22. The third induction heating coil 127*b* has a third coil 136*b* formed by eight turns of an electric wire on the magnetic core 28.

Figure 11:
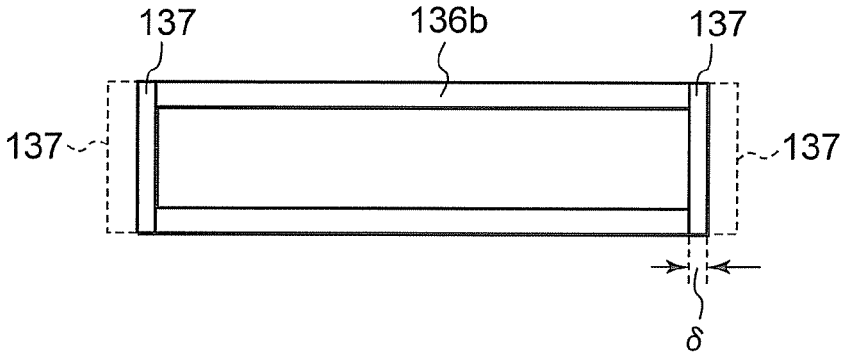
FIG. 11 is a schematic plan view showing a third induction heating coil according to the second embodiment of the invention.
Figure 12:
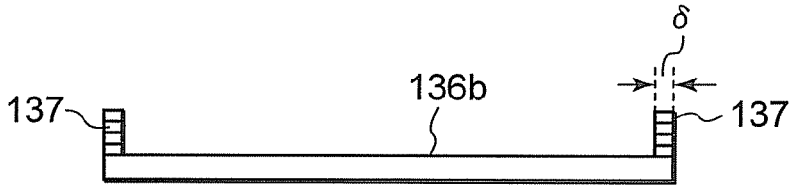
FIG. 12 is a schematic side view showing the third induction heating coil according to the second embodiment of the invention.

The third coil 136*b* is formed as shown in FIG. 11 and FIG. 12. For example, after eight turns of the electric wire is made on the same plane, both end parts 137 in the longitudinal direction are perpendicularly bent and processed. Thus, the thickness δ of both end parts 137 in the longitudinal direction of the third coil 136*b*, that is, the overlapping part of the first induction heating coil 27*a* with the first coil 36*a*, can be restrained to the thickness of one layer of electric wire. Therefore, with the use of this third coil 136*b*, the gap ϵ between the neighboring magnetic cores 28 dispersed into plural parts in the longitudinal direction of the heat roller 22 can be narrowed to 5 mm. Thus, the occurrence of uneven temperature in the heat roller 22 caused by the gap ϵ between the neighboring magnetic cores 28 can be securely prevented.

As a method of processing the third coil 136*b*, when the electric wire is wound, the coil at both end parts 137 in the longitudinal direction of the third coil 136*b* may be formed in one layer in the gap ϵ between the neighboring magnetic cores 28.

According to this embodiment, as in the above first embodiment, since the heat roller 22 is heated across the total length by the first induction heating coil 27*a* alone which has no coil joint, the occurrence of uneven temperature in the heat roller 22 which would traditionally be caused by a coil joint can be prevented. Moreover, since the gap ϵ between the neighboring magnetic cores 28 is as narrow as 5 mm, the occurrence of uneven temperature in the heat roller 22 caused by the gap ϵ can be prevented more securely.

Furthermore, according to this embodiment, as in the first embodiment, temperature variance in the heat roller 22 can be reduced and no interference noise occurs, compared with the traditional device. Also, the temperature distribution in the longitudinal direction of the heat roller 22 can be kept constant irrespective of the size of the sheet of paper P. There is no adverse effect of a temperature rise in the end parts of the heat roller 22 on the peripheral devices and a good fixing property can be provided.

Next, a third embodiment of the invention will be described. This third embodiment differs from the above first embodiment in the shape of the magnetic core, and the other parts are similar to those of the first embodiment. Therefore, in this third embodiment, the configuration described in the above first embodiment is denoted by the same reference numerals and will not be described further in detail.

Figure 13:
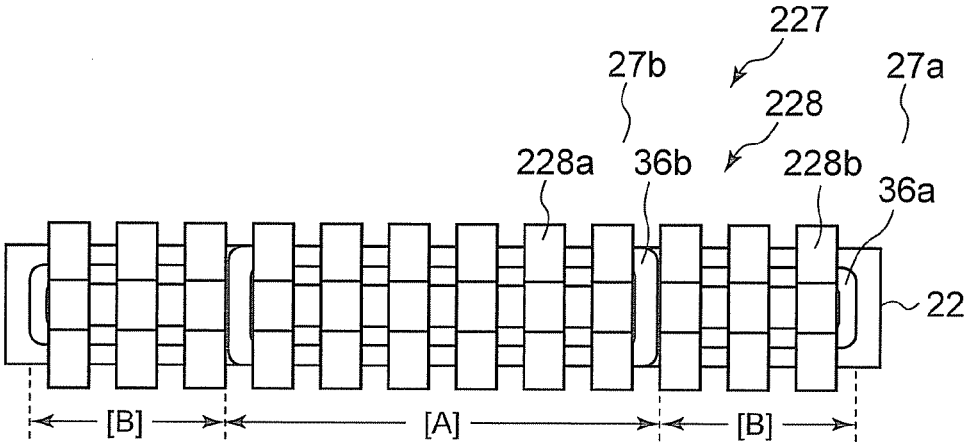
FIG. 13 is a schematic plan view showing an induction heating coil according to a third embodiment of the invention.

The third embodiment uses an induction heating coil 227 shown in FIG. 13, in order to heat the heat roller 22. The induction heating coil 227 is substantially coaxial with the heat roller 22 and includes a first induction heating coil 27*a* and a second induction heating coil 27*b*. A magnetic core 228 of the induction heating coil 227 has different shapes between an area [A] and an area [B] shown in FIG. 13.

Figure 14:
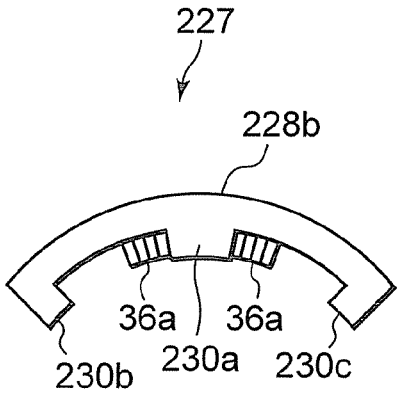
FIG. 14 is a schematic explanatory view showing a side core according to the third embodiment of the invention.
Figure 15:
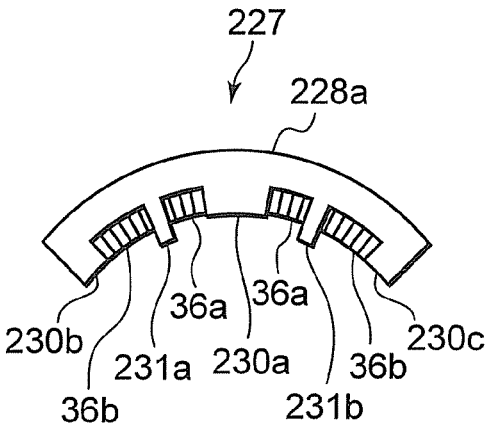
FIG. 15 is a schematic explanatory view showing a central core according to the third embodiment of the invention.

At the center and both sides of a side core 228*b* in the area [B] where only the first coil 36*a* of the first induction heating coil 27*a* is wound, magnetic shielding members 230*a*, 230*b* and 230*c* are provided in a protruding manner, as shown in FIG. 14. Meanwhile, on a central core 228*a* in the area [A] where the first coil 36*a* of the first induction heating coil 27*a* and the second coil 36*b* of the second induction heating coil 27*b* are wound, intermediate shielding members 231*a* and 231*b* that magnetically shields the space between the first coil 36*a* and the second coil 36*b* are provided in a protruding manner, in addition to the magnetic shielding members 230*a*, 230*b* and 230*c*, as shown in FIG. 15.

In this embodiment, only one of the first induction heating coil 27*a* and the second induction heating coil 27*b* is selectively driven. That is, even if an induced current flows through the other coil in the area [A], it does not affect the heating of the heat roller 22. However, a mutual induced current will be a factor that causes noise on the side of the inverter circuit 50. Therefore, the inverter circuit 50 needs preventive measures such as providing a noise filter. Also, as the driving frequency of the coil is increased, heat loss due to an eddy-current is generated even with a copper wire. Therefore, the mutual induced current should be less.

In the central core 228*a* on which the first and second coils 36*a* and 36*b* are wound, the mutual induced current between the first coil 36*a* and the second coil 36*b* is reduced by the provision of the intermediate shielding members 231*a* and 231*b*.

According to this embodiment, as in the above first embodiment, since the heat roller 22 is heated across the total length by the first induction heating coil 27*a* alone which has no coil joint, the occurrence of uneven temperature in the heat roller 22 which would traditionally be caused by a coil joint can be prevented. Moreover, since the intermediate shielding members 231*a* and 231*b* that magnetically shields the space between the first and second coils 36*a* and 36*b* are provided on the central core 228*a* on which the first and second coils 36*a* and 36*b* are wound, a mutual induced current is prevented. As a result, noise in the inverter circuit 50 due to a mutual induced current can be prevented. Noise preventive measures on the side of the inverter circuit 50 are not necessary, and reduction in cost can be realized. Also, heat loss due to a mutual induced current is prevented and the heating efficiency of the heat roller 22 is improved.

Furthermore, according to this embodiment, as in the first embodiment, temperature variance in the heat roller 22 can be reduced and no interference noise occurs, compared with the traditional device. Also, the temperature distribution in the longitudinal direction of the heat roller 22 can be kept constant irrespective of the size of the sheet of paper P. There is no adverse effect of a temperature rise in the end parts of the heat roller 22 on the peripheral devices and a good fixing property can be provided.

Next, a fourth embodiment of the invention will be described. This fourth embodiment differs from the above first embodiment in the shape of the first induction heating coil, and the other parts are similar to those of the first embodiment. Therefore, in this fourth embodiment, the same configuration as the configuration described in the above first embodiment is denoted by the same reference numerals and will not be described further in detail.

In the fourth embodiment, an induction heating coil 327 shown in FIG. 16 is used in order to heat the heat roller 22. The induction heating coil 327 is substantially coaxial with the heat roller 22 and includes a fourth induction heating coil 327*a* as the first induced current generating coil that heats the heat roller 22 across the total length, and a fifth induction heating coil 327*b* that heats the central area of the heat roller 22. The fourth induction heating coil 327*a* has a smaller lateral width $\eta$ in the area [A] than a lateral width $\theta$ in the area [B]. As the lateral width $\eta$ in the area [A] of the fourth induction heating coil 327*a* is reduced, increase in the size of the induction heating coil 327 in the area [A] is prevented.

Of the induction heating coil 327, the fifth induction heating coil 327*b* crosses the fourth induction heating coil 327*a* and is arranged on the outer side than the fourth induction heating coil 327*a* in the area [A]. Therefore, if the lateral width of the fourth induction heating coil 327*a* is even across the total length in the longitudinal direction, a space where the fifth induction heating coil 327*b* can be arranged, must be taken in the lateral direction in the area [A]. Therefore, as the lateral width $\eta$ in the area [A] of the fourth induction heating coil 327*a* is reduced, increase in the size of the induction heating coil 327 in the area [A] can be prevented even if the fifth induction heating coil 327*b* is arranged.

However, if the lateral side of the fourth induction heating coil 327*a* is made too small across the total length, the magnetic coupling with the heat roller 22 weakens and the load resistance of the fourth induction heating coil 327*a* decreases. This reduces the output of the fourth induction heating coil 327*a* to heat the entire heat roller 22. Thus, the lateral width of the fourth induction heating coil 327*a* in the area [B], where the fifth induction heating coil 327*b* does not exist, is broadened. That is, the magnetic coupling of the fourth induction heating coil 327*a* with the heat roller 22 is made stronger to increase the load resistance of the fourth induction heating coil 327*a*. This increases the output of the fourth induction heating coil 327*a* to heat the entire heat roller 22.

As a result, the efficiency of heating the heat roller 22 by the fourth induction heating coil 327*a* can be improved. Moreover, there is large heat escape from both end parts of the heat roller 22 because of the structure of bearing and the like. Therefore, a temperature fall tends to occur in the two end parts of the heat roller 22. However, since the lateral width of the fourth induction heating coil 327*a* in the area [B] is large and it provides a large heating output, the heat escape due to the structure can be compensated for and the temperature fall in the two end parts of the heat roller 22 can be solved.

According to this embodiment, as in the above first embodiment, since the heat roller 22 is heated across the total length by the fourth induction heating coil 327*a* alone which has no coil joint, the occurrence of uneven temperature in the heat roller 22 which would traditionally be caused by a coil joint can be prevented. Moreover, the lateral width in the area [A] of the fourth induction heating coil 327*a* is made smaller than the lateral width in the area [B] and increase in the size of the induction heating coil 327 can be prevented in the case where the fifth induction heating coil 327*b* is arranged. Meanwhile, as the lateral width in the area [B] of the fourth induction heating coil 327*a* is increased, the output of the fourth induction heating coil 327*a* to heat the entire heat roller 22 is increased and a temperature fall in the two end parts 22*a* of the heat roller 22 is prevented.

Furthermore, according to this embodiment, as in the first embodiment, temperature variance in the heat roller 22 can be reduced and no interference noise occurs, compared with the traditional device. Also, the temperature distribution in the longitudinal direction of the heat roller 22 can be kept constant irrespective of the size of the sheet of paper P. There is no adverse effect of a temperature rise in the end parts of the heat roller 22 on the peripheral devices and a good fixing property can be provided.

Next, a fifth embodiment of the invention will be described. In this fifth embodiment, the properties of the first induction heating coil and the second induction heating coil in the above first embodiment are regulated, and the other parts are similar to those of the first embodiment. Therefore, in this fifth embodiment, the same configuration as the configuration described in the above first embodiment is denoted by the same reference numerals and will not be described further in detail.

In the fifth embodiment, an induction heating coil 427 shown in FIG. 17 is used in order to heat the heat roller 22. The induction heating coil 427 is substantially coaxial with the heat roller 22 and includes a sixth induction heating coil 427*a* as a first induced current generating coil that heats the heat roller 22 across the total length, and a seventh induction heating coil 427*b* as a second induced current generating coil that heats the central area of the heat roller 22.

The sixth induction heating coil 427*a* has a length of 320 mm and a lateral width of 50 mm. The seventh induction heating coil 427*b* has a length of 200 mm and a lateral width of 70 mm. The inductance and the load resistance values of the sixth induction heating coil 427*a* and the seventh induction heating coil 427*b* in the case where the driving frequency f of the inverter circuit 50 is 25 kHz, were measured by an LCR meter and the results shown FIG. 18 were acquired.

The sixth induction heating coil 427*a* has an inductance L1=29 μH and a load resistance value R1=1.2Ω. The seventh induction heating coil 427*b* has an inductance L2=27 μH and a load resistance value R2=1.0Ω. The ratio of inductance to load resistance value, L/R (μH/Ω), which represents the coupling of magnetic fluxes, is L1/R1=24.2 (μH/Ω) for the sixth induction heating coil 427*a*, whereas the ratio is L2/R2=27 (μH/Ω) for the seventh induction heating coil 427*b*. That is, L1/R1<L2/R2 holds.

As the ratio of inductance to load resistance value, L/R (μH/Ω), is smaller, a larger maximum output of the coil can be provided. That is, the maximum output value of the sixth induction heating coil 427*a* is larger than the maximum output value of the seventh induction heating coil 427*b*. Therefore, the sixth induction heating coil 427*a* can warm up at a high speed.

In this embodiment, where the power-supply voltage is 100 V, since the maximum output usable to the entire machine is limited to 1500 W, the maximum output that can be supplied to the fixing device 11 is limited, too. For example, the maximum output that can be supplied to the fixing device 11 is 1000 W in a paper-passing state and 700 W in a ready state. However, at the time of warm-up, the maximum output that can be supplied to the fixing device 11 is 1300 W in order to realize high-speed warm-up.

In this embodiment, the timing of driving the seventh induction heating coil 427*b* is only at the time of passing a paper, whereas the timing of driving the sixth induction heating coil 427*a* is at the time of warm-up, being ready, and passing a paper. Therefore, the sixth induction heating coil 427*a* needs the output value of 1300 W for warm-up.

Accordingly, in this embodiment, the output range of the sixth induction heating coil 427*a* is set to 700 to 1300 W and the output range of the seventh induction heating coil 427*b* is set to 700 to 1000 W.

Also, since the maximum output and the output range differ between the sixth induction heating coil 427*a* and the seventh induction heating coil 427*b*, their magnetic coupling with the heat roller 22 may differ. That is, the seventh induction heating coil 427*b*, which has the smaller maximum output and output range, may have smaller magnetic coupling with the heat roller 22. Therefore, in the seventh induction heating coil 427*b*, the inner gap λ of the coil can be smaller and the number of turns of the electric wire can be reduced. It contributes to miniaturization.

According to this embodiment, as in the above first embodiment, since the heat roller 22 is heated across the total length by the sixth induction heating coil 427*a* alone which has no coil joint, the occurrence of uneven temperature in the heat roller 22 which would traditionally be caused by a coil joint can be prevented. Moreover, as L1/R1<L2/R2 holds between the sixth induction heating coil 427*a* and the seventh induction heating coil 427*b*, the maximum output value of the sixth induction heating coil 427*a* heating the heat roller 22 across the total length can be 1300 W, and the warm-up time can be reduced. Also, as the magnetic coupling is made different between the sixth induction heating coil 427*a* and the seventh induction heating coil 427*b* and the magnetic coupling of the seventh induction heating coil 427*b* is made smaller, miniaturization of it can be realized.

Furthermore, according to this embodiment, as in the first embodiment, temperature variance in the heat roller 22 can be reduced and no interference noise occurs, compared with the traditional device. Also, the temperature distribution in the longitudinal direction of the heat roller 22 can be kept constant irrespective of the size of the sheet of paper P. There is no adverse effect of a temperature rise in the end parts of the heat roller 22 on the peripheral devices and a good fixing property can be provided.

Next, a sixth embodiment of the invention will be described. In this sixth embodiment, a heating source is provided in the press roller in the above first embodiment, and the other parts are similar to those of the first embodiment. Therefore, in this sixth embodiment, the same configuration as the configuration described in the above first embodiment is denoted by the same reference numerals and will not be described further in detail.

Figure 19:
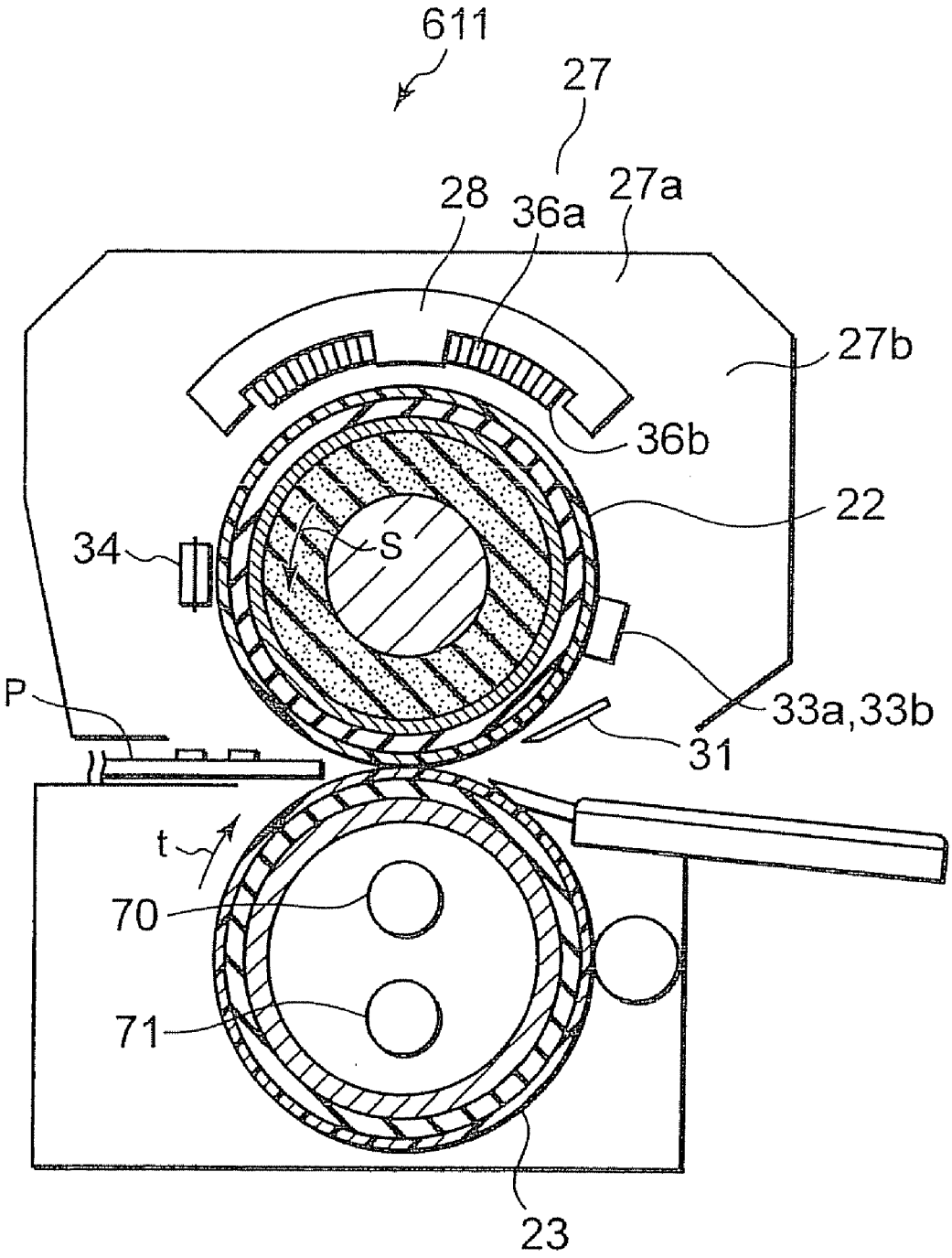
FIG. 19 is a schematic configuration view showing a fixing device according to a sixth embodiment of the invention.
Figure 20:
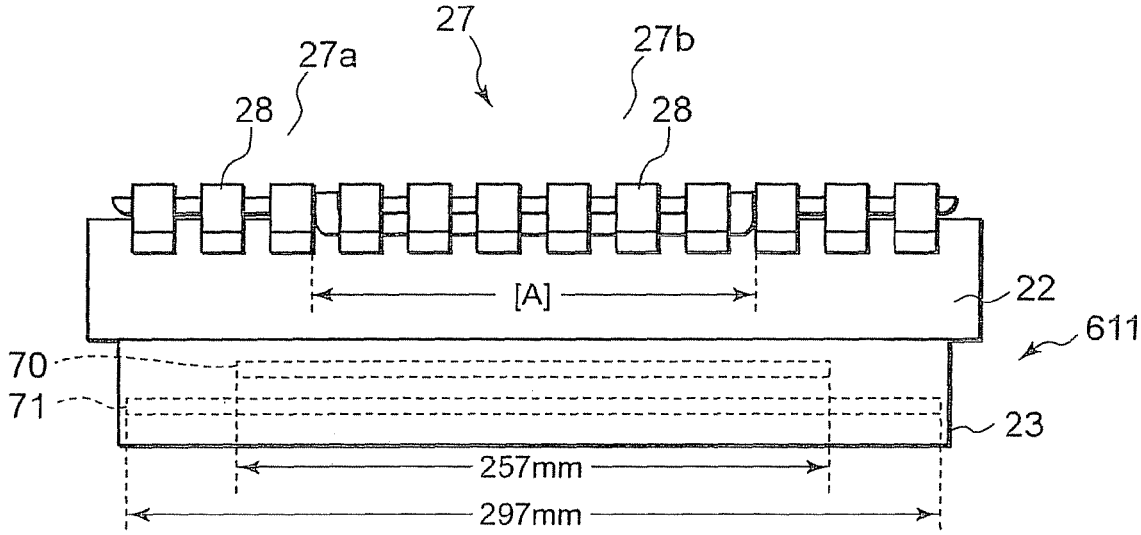
FIG. 20 is a schematic plan view showing an induction heating coil according to the sixth embodiment of the invention.

In the sixth embodiment, a first lamp 70 and a second lamp 71, which are heating sources and made of halogen lamps, are provided in a press roller 23 of a fixing device 611, as shown in FIG. 19 and FIG. 20. The first lamp 70 and the second lamp 71 use a dedicated battery as their power source. Therefore, the first lamp 70 and the second lamp 71 do not affect the driving power for the first induction heating coil 27*a* and the second induction heating coil 27*b*.

The heating area of the first lamp 70 is, for example, the width of B4 vertical size of JIS standard (257 mm). That is, the heating area of the first lamp 70 is between the heating area of the first induction heating coil 27*a* and the heating area of the second induction heating coil 27*b* (area [A]). The heating area of the second lamp 71 is the width of A4 horizontal size (297 mm).

At the time of warm-up, the first induction heating coil 27*a* is driven and the second lamp 71 is turned on. This further reduces the warm-up time. Also, at the time of fixation, if the size of the sheet of paper P is, for example, B4 vertical size, the first induction heating coil 27*a* and the second induction heating coil 27*b* are controlled in accordance with the flowchart of FIG. 8 and the first lamp 70 is turned on. This realizes even temperature distribution in the longitudinal direction of the heat roller 22 even at the time of fixation for the size of sheet of paper P between the heating area of the first induction heating coil 27*a* and the heating area of the second induction heating coil 27*b* (area [A]). The first lamp 70 and the second lamp 71 may also be driven by a 100-V commercial power source instead of using the dedicated battery. Also, the heating areas of the first lamp 70 and the second lamp 71 are not limited and may be letter size vertical (215.9×279.4 mm), tabloid size vertical (279.4×431.8 mm), and so on, between the first induction heating coil 27*a* and the second induction heating coil 27*b*.

According to this embodiment, as in the above first embodiment, the occurrence of uneven temperature in the heat roller 22 which would traditionally be caused by a coil joint can be prevented. Moreover, as the first lamp 70 and the second lamp 71 are provided in the press roller 23, the warm-up time can be further reduced. Also, even in the case of carrying out a fixing operation on the sheet of paper P of an intermediate size between the heating area of the first induction heating coil 27*a* and the second induction heating coil 27*b*, even temperature distribution in the longitudinal direction of the heat roller 22 can be realized. Moreover, since on-off control of the first lamp 70 and the second lamp 71 is carried out with the dedicated battery, they do not affect the driving power for the first induction heating coil 27*a* and the second induction heating coil 27*b*.

Furthermore, according to this embodiment, as in the first embodiment, temperature variance in the heat roller 22 can be reduced and no interference noise occurs, compared with the traditional device. Also, the temperature distribution in the longitudinal direction of the heat roller 22 can be kept constant irrespective of the size of the sheet of paper P. There is no adverse effect of a temperature rise in the end parts of the heat roller 22 on the peripheral devices and a good fixing property can be provided.

The invention is not limited to the above embodiments and various changes can be made within the scope of the invention. For example, the endless heating member may be a fixed belt, and the shape, properties and the like of the first induction heating coil or the second induction heating coil are not limited. Moreover, the size and arrangement of the first induction heating coil or the second induction heating coil are not limited, either. For example, in a side-pass image forming apparatus, the second induction heating coil is arranged near one end of the first induction heating coil.

What is claimed is:

1. An induction heating fixing device comprising:

an endless heating member having a metal conductive layer;

a first induced current generating coil arranged on an outer circumference of the heating member and configured to generate an induced current in the metal conductive layer across a total length in the direction of a rotation axis of the heating member;

a second induced current generating coil arranged on the outer circumference of the heating member and configured to generate an induced current in the metal conductive layer at a part in the direction of the rotation axis of the heating member; and a control member configured to drive the first induced current generating coil or the second induced current generating coil in a switching manner.

2. The induction heating fixing device according to claim 1, wherein a number of turns of an electric wire of the first induced current generating coil is smaller than a number of turns of an electric wire of the second induced current generating coil.

3. The induction heating fixing device according to claim 1, wherein a distance from the first induced current generating coil to the heating member is substantially the same as a distance from the second induced current generating coil to the heating member.

4. The induction heating fixing device according to claim 3, wherein the distance from the first induced current generating coil to the heating member and the distance from the second induced current generating coil to the heating member are 1 to 5 mm.

5. The induction heating fixing device according to claim 3, wherein the second induced current generating coil is arranged on the outer side than the first induced current generating coil.

6. The induction heating fixing device according to claim 1, the first induced current generating coil has a first core, and the second induced current generating coil has a second core, with the second core sharing a part of the first core.

7. The induction heating fixing device according to claim 6, wherein the first core and the second core are divided into plural parts at a predetermined spacing in a longitudinal direction of the heating member, and both end parts in the longitudinal direction of the second induced current generating coil are stacked at the spacing perpendicularly to the surface of the heating member.

8. The induction heating fixing device according to claim 6, wherein further comprising a shielding member between the first induced current generating coil and the second induced current generating coil, and the shielding member is formed by a part of the first core.

9. The induction heating fixing device according to claim 1, further comprising a shielding member between the first induced current generating coil and the second induced current generating coil.

10. The induction heating fixing device according to claim 1, wherein the first induced current generating coil has a coil width that is larger at a position where the second induced current generating coil is not arranged than a position where the second induced current generating coil is arranged.

11. The induction heating fixing device according to claim 1, wherein the part in the direction of the rotation axis of the heating member is a central part in the direction of the rotation axis of the heating member.

12. The induction heating fixing device according to claim 1, wherein $L1/R1<L2/R2$ holds where the first induced current generating coil has an inductance L1 and a load resistance value R1 and the second induced current generating coil has an inductance L2 and a load resistance value R2.

13. The induction heating fixing device according to claim 12, wherein the first induced current generating coil has an output variable range larger than an output variable range of the second induced current generating coil.

14. An induction heating fixing device comprising:

an endless heating member having a metal conductive layer;

a first induced current generating coil arranged on an outer circumference of the heating member and configured to generate an induced current in the metal conductive layer across a total length in the direction of a rotation axis of the heating member;

a second induced current generating coil arranged on the outer circumference of the heating member and configured to generate an induced current in the metal conductive layer at a part in the direction of the rotation axis of the heating member;

a control member configured to drive the first induced current generating coil or the second induced current generating coil in a switching manner;

a pressurizing member configured to form a nipping part by being pressed in contact with the heating member and to nip and carry a fixing target medium having a toner image together with the heating member into a predetermined direction; and a heating source configured to heat the pressurizing member, at least one heating area in the longitudinal direction of the pressurizing member differing from heating areas in the heating member heated by the first induced current generating coil and the second induced current generating coil.

15. The induction heating fixing device according to claim 14, wherein the first induced current generating coil has a coil width that is larger at a position where the second induced current generating coil is not arranged than a position where the second induced current generating coil is arranged.

16. The induction heating fixing device according to claim 14, wherein the part in the direction of the rotation axis of the heating member is a central part in the direction of the rotation axis of the heating member.

17. The induction heating fixing device according to claim 12, wherein the first induced current generating coil has a maximum output value larger than a maximum output value of the second induced current generating coil.

18. The induction heating fixing device according to claim 14, wherein a number of turns of an electric wire of the first induced current generating coil is smaller than a number of turns of an electric wire of the second induced current generating coil.

19. The induction heating fixing device according to claim 14, wherein at least one heating distribution area of the heating source is longer than a heating distribution area of the second induced current generating coil.

20. The induction heating fixing device according to claim 14, wherein a distance from the first induced current generating coil to the heating member is substantially the same as a distance from the second induced current generating coil to the heating member, and the second induced current generating coil is arranged on the outer side than the first induced current generating coil.

21. The induction heating fixing device according to claim 14, the first induced current generating coil has a first core, and the second induced current generating coil has a second core, with the second core sharing a part of the first core.

22. The induction heating fixing device according to claim 21, wherein the first core and the second core are divided into plural parts at a predetermined spacing in a longitudinal direction of the heating member, and both end parts in the longitudinal direction of the second induced current generating coil are stacked at the spacing perpendicularly to the surface of the heating member.

23. The induction heating fixing device according to claim 21, wherein further comprising a shielding member between the first induced current generating coil and the second induced current generating coil, and the shielding member is formed by a part of the first core.

24. The induction heating fixing device according to claim 14, further comprising a shielding member between the first induced current generating coil and the second induced current generating coil.

* * * * *